US006393248B1

(12) United States Patent
Tsurusaki et al.

(10) Patent No.: US 6,393,248 B1
(45) Date of Patent: May 21, 2002

(54) FIXING DEVICE OF IMAGE FORMING APPARATUS AND FIXING ROLLER

(75) Inventors: Teruaki Tsurusaki; Shuho Yokokawa; Kunitomo Takahashi; Sho Sawahata; Ken Onodera, all of Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/709,507

(22) Filed: Nov. 13, 2000

(30) Foreign Application Priority Data

Nov. 12, 1999 (JP) ..... 11-322036

(51) Int. Cl.[7] ..... G03G 15/20
(52) U.S. Cl. ..... 399/330
(58) Field of Search ..... 399/320, 328, 399/330, 333, 335; 347/156; 430/99, 124

(56) References Cited

U.S. PATENT DOCUMENTS 5,173,736 A * 12/1992 Cherian ..... 399/330
5,332,641 A * 7/1994 Finn et al. ..... 430/124
5,621,512 A * 4/1997 Uehara et al. ..... 399/328
5,659,848 A * 8/1997 Jeon ..... 399/330 X
5,716,714 A * 2/1998 Chen et al. ..... 430/99 X
5,729,813 A * 3/1998 Eddy et al. ..... 399/333
5,999,789 A * 12/1999 Sawamura ..... 399/330

FOREIGN PATENT DOCUMENTS

JP 6-93154 11/1994
JP 7-46253 5/1995

* cited by examiner

*Primary Examiner*—Sandra Brase
(74) *Attorney, Agent, or Firm*—Sughrue Mion, PLLC

(57) ABSTRACT

In a fixing device of an image forming apparatus, at least one roller of a pair of rollers (14, 15) that come into pressure contact with each other is regulated so that outer diameter of the roller is 80 to 120 mm and total length of the roller (length in the axial direction) is 470 to 600 mm, and the roller is driven and rotated at the number of revolutions of 60 to 300 rpm by fitting a key groove (14*c*) formed at an end of the roller to a drive key (27*a*) provided for a drive force-transmitting shaft. Further, average thickness of core metal material (14*a*) of the fixing roller is regulated so that the moment of inertia in a direction of a rotational shaft of the fixing roller is 70 Kg·cm$^2$ and less.

4 Claims, 3 Drawing Sheets

FIXING DEVICE OF IMAGE FORMING APPARATUS AND FIXING ROLLER

BACKGROUND OF THE INVENTION

1. Field of the Invention

The present invention relates to a fixing device and a fixing roller of an image forming apparatus such as a laser printer, a copier, and the like.

2. Description of the Related Art

As a fixing device of an image forming apparatus such as a laser printer, a copier, and the like, a heat roller fixing system has been known, in which recording material (for example, paper, an OHP sheet, or the like) holding an unfixed toner image is nipped and transported while the recording material being heated and pressed by a pair of fixing rollers, thereby to fix the unfixed toner image onto the recording material. Generally, a pair of the fixing rollers comprises a heat roller having a heat source, and a pressure roller not having the heat source, provided so as to be brought into pressure contact with the heat roller. However, in a high-speed printing machine, or a field of a printing machine in which unfixed toner images formed on both sides of the recording material are simultaneously fixed, it is proposed that the fixing roller comprises a pair of the heat rollers.

In the heat roller fixing system of this kind, at least one roller of a pair of the heat rollers is composed of a drive roller, and the other is composed of a driven roller that is rotated by the pressure contact with the drive roller. One mode of power transmission mechanism in this case has been disclosed in JP-B-6-93154 and JP-B-7-46253, in which a key groove formed at a roller end portion is fitted to a drive key provided for a drive force-transmitting shaft, thereby to transmit the drive force to the fixing rollers.

In the heat roller fixing system disclosed in JP-B-6-93154 and JP-B-7-46253, the heat roller forming the fixing roller pair is constituted as a drive roller; and the diameter of the heat roller is set to 100 mm, the total length thereof (in the axial direction) is set to 560 mm, and the average thickness of the core metal material (for example, made of aluminum) thereof is set to 8 mm, thereby to obtain a large caliber heat roller and rotate this heat roller at the number of revolutions of 216 rpm.

As a result, a moment of inertia in a direction of a rotational shaft of the heat roller reaches about 70 $Kg \cdot cm^2$ In case that the key groove (in the key groove, buffer material as described in JP-B-7-46253 is provided) of the heat roller has received the drive force from the drive key for a long time, before the print amount reaches the permissible amount, break was produced due to heat and fatigue. Further, since the heat capacity of the core metal material of the heat roller was also large (about 2 kW), consumed power at the above number of revolutions was also large.

Accordingly, under the above constitution, the break of the key groove or of the buffer material provided in the key groove proceeds more speedily than in the usual driving system. Therefore, even if the fixing roller does not reach an end of lifetime, such disadvantage is caused that the expensive fixing roller must be exchanged due to the break of the key groove or of the buffer material.

SUMMARY OF THE INVENTION

An object of the invention is, even in case that the fixing roller is rotated at a high speed, without causing the increase of the consumed electric power, to provide a fixing device and a fixing roller of an image forming apparatus which can suppress increase of the moment of inertia in the direction of the rotational shaft of the fixing roller and early break of the key groove, and which can lengthen particularly the lifetime of the fixing roller.

In order to achieve the above object, a fixing device of an image forming apparatus comprises:

a first fixing roller;

a second fixing roller come into pressure contact with the first fixing roller, the second fixing roller including a cylindrical metal core having an outer diameter of 80 to 120 mm and a length in axial direction of 470 to 600 mm, the second fixing roller defining a first groove at one end of the cylindrical metal core; and a driving shaft having a protrution engaged with the first groove of the cylindrical metal core; wherein the second roller is driven and rotated at the number of revolutions of 60 to 300 rpm; and an average thickness of the cylindrical metal core is regulated so that the moment of inertia in a direction of a rotational shaft of the second fixing roller is no more than 70 $Kg \cdot cm^2$.

DETAILED DESCRIPTION OF THE PREFERRED EMBODIMENTS

One embodiment of the invention will be described below in detail with reference to drawings. First, the whole constitution of a laser beam printer using electrophotographic system according to the invention will be described with reference to FIG. 4.

Figure 4:
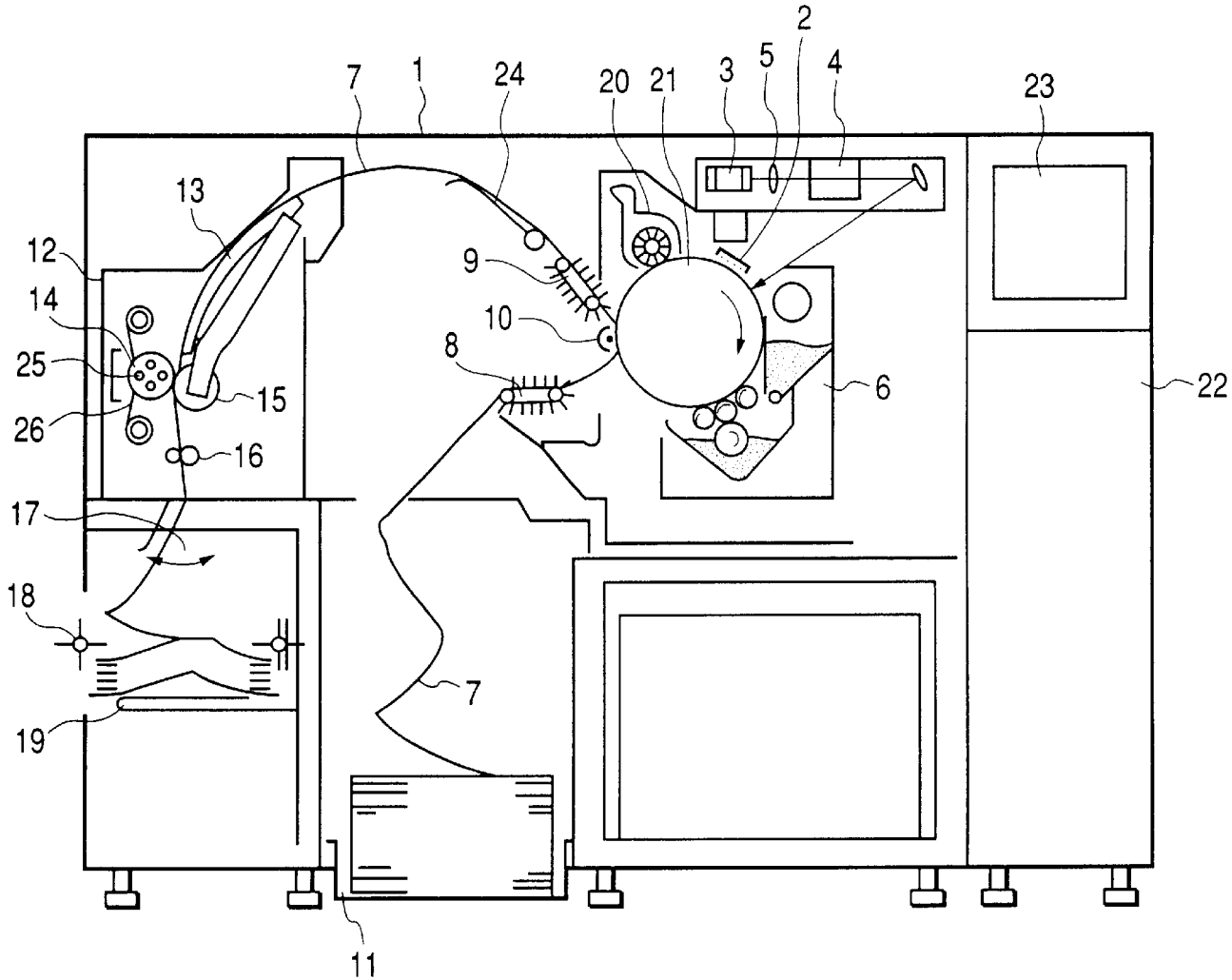
FIG. 4 is a whole constitutional view of a laser beam printer according to the invention.

In FIG. 4, reference numeral 1 is a laser beam printer, and a photosensitive drum 21 starts rotating in an arrowed direction on the basis of a print operation-starting signal from a controller 22 of the laser beam printer. The photosensitive drum 21 rotates at speed corresponding to a printing speed of the laser beam printer 1, and continues to rotate till the print operation is completed. When the photosensitive drum 21 starts rotating, a high voltage is applied to a corona charger 2, and for example, positive charges are uniformly applied onto a surface of the photosensitive drum 21.

Immediately when power is input in the laser beam printer, a rotating polyhedral mirror 3 starts rotating, and its rotation is kept at a constant speed with high accuracy while the power is input. A laser beam output from a semiconductor laser 4 is reflected by the rotating polyhedral mirror 3, and irradiated on the photosensitive drum 21 through an fη lens 5 while the laser beam is being scanned on the photosensitive drum 21.

Character data and figure data that have been converted into dot images are sent as ON/OFF signals of the laser beam from the controller 22 to the laser beam printer 1. Then, a portion on which the laser beam is irradiated and a portion on which the laser beam is not irradiated are formed on the surface of the photosensitive drum 21, that is, an electrostatic latent image is formed. When the photosensitive drum region carrying the electrostatic latent image reaches a position opposite to a developing device 6, toner is supplied onto the electrostatic latent image, so that onto a position where the electric charges on the photosensitive drum 21 disappear due to the irradiation of the laser beam, for example, the toner having the positive charge is attracted by static electricity, whereby the toner image is formed on the photosensitive drum 21.

Continuous paper 7 stored in a paper hopper 11 is transported between the photosensitive drum 21 and a transfer means 10 by a paper transporting tractor 8 in synchronization with a timing at which the toner image of a print data formed on the photosensitive drum 21 reaches a transfer position.

The toner image formed onto the photosensitive drum 21 is attracted on the paper 7 by action of the transfer means 10 that gives the electric charge having polarity opposite to that of the toner image to the back surface side of the paper 7.

Thus, the paper 7 set in the paper hopper 11 is transported to a fixing device 12 through the paper transporting tractor 8, the transfer means 10, a paper transporting tractor 9 and a buffer plate 24. The paper 7 that has reached the fixing device 12 is previously heated by a pre-heater 13. Thereafter, while the paper 7 is being heated and pressed at a nip portion formed by a pair of fixing rollers that comprises a heat roller 14 having a heat lamp 25 and a press roller 15, the paper 7 is nipped and transported, so that the toner image is melted and fixed onto the paper 7.

The paper 7 fed out by the heat roller 14 and the press roller 15 is sent out to a stacker table 19 by a paper feed roller 16, and it is alternatively bent and divided along perforations by a swinging operation of a swing fin 17. Further, while the folding state is being arranged by a rotating paddle 18, the paper 7 is stacked on a stacker table 19. A region of the photosensitive drum 21 which has passed the transfer position is cleaned by a cleaning device 20, and the photosensitive drum 21 is prepared for a next printing operation.

In FIG. 4, reference numeral 23 is a display screen for displaying data on the basis of a state of the laser beam printer 1 during the print operation. Further, in case that a difference in paper transporting speed is produced among the paper transporting tractor 9, the fixing rollers 14 and 15, the above-described buffer plate 24 is used in order to absorb a slack or tension produced in the paper 7. Further, reference numeral 26 is a web member that is provided so that the web member 26 can come into contact with the surface of the heat roller 14 and can be rewound, and the web member 26 is used in order to clean the surface of the heat roller 14 and apply a parting agents onto the surface of the heat roller 14.

Figure 1:
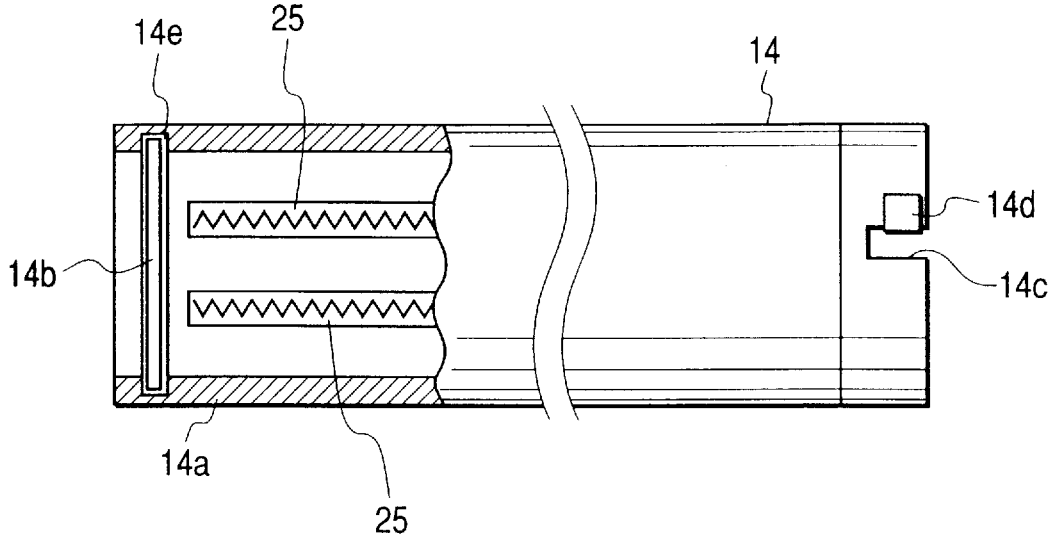
FIG. 1 is a schematically constitutional view of a partial section showing one embodiment of a fixing roller of the invention.
Figure 2:
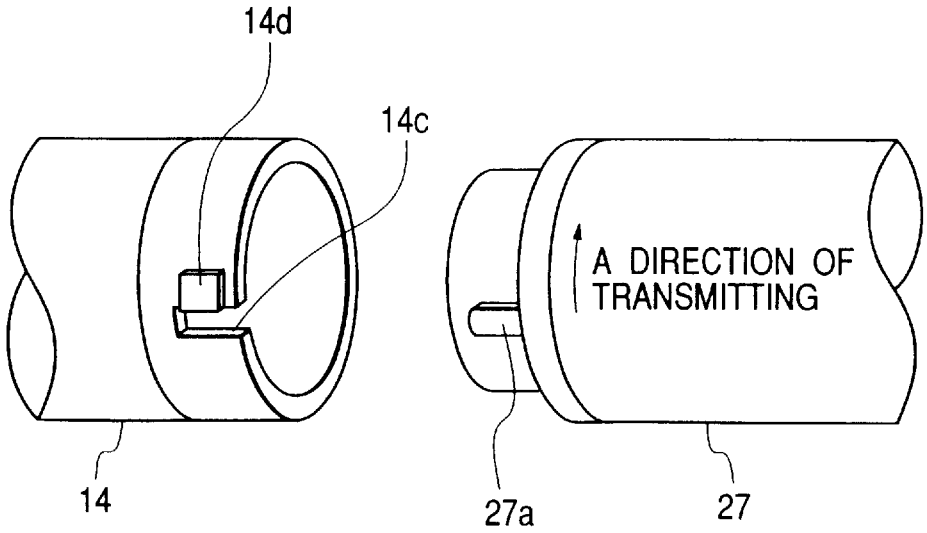
FIG. 2 is a perspective view showing a coupling portion of the fixing roller and a drive force-transmitting shaft.

In FIG. 1, reference numeral 14*a* is a core metal material of the heat roller, 14*b* is a shield plate that is fitted into the inner peripheral portion of the core metal material 14*a* in order to shield heat of the heater lamp 25, 14*c* is a key groove, 13*d* is a buffer material for preventing wear of the key grove 14*c*, and 14*e* is a groove formed at the inner peripheral portion of the core metal material 14*a* in order to fit the shield plate 14*b* therein. Further, however not shown, the shield plate 14*b* is also fitted into the inner peripheral portion of the core metal material 14*a* on a side where the key groove 14*c* is provided.

In this embodiment, the core metal material 14*a* is defined by a roller made of aluminum such as A5052, and an outer peripheral surface of the core material 14*a* is coated with non-adhesive resin such as Teflon, and thereby a parting layer is provided thereon. The heat roller 14 which is defined as the above described, is attached to a drive force-transmitting shaft 27 in such shaft 27 is transmitted to the heat roller 14. Here, at least the drive key 27*a* defines quenching carbon steel having hardness of HRC 30 to 50. Further, an outer diameter of the heat roller 14 is set t 100 mm, and a total length (in the axial direction) thereof is set to 600 mm.

In the constitution of the above heat roller, a relation between a value of an average thickness of the core metal material 14*a* and a moment of inertia in a direction of the rotational shaft of the heat roller 14 is examined. As a result, when the average thickness of the core metal material 14*a* is 5 mm, the moment of inertia in the direction of the rotational shaft of the heat roller 14 can be made about 60 $kg \cdot cm^2$. Though the total length of the heat roller 14 is longer than that of a conventional heat roller by about 7%, the moment of inertia in the direction of the rotational shaft of the heat roller 14 can be reduced by about 14% in relation to that of the conventional heat roller, so that even if the heat roller 14 is rotated at the number of revolution of 300 rpm, a load applied onto the key groove 14*c* of the heat roller 14 can be reduced greatly. Further, the average thickness of the core metal material 14*a* is reduced, whereby heat capacity of the core metal material 14*a* becomes about 1.75 kW, so that consumed electric power can be reduced by about 13% in relation to that of the conventional heat roller.

Figure 3:
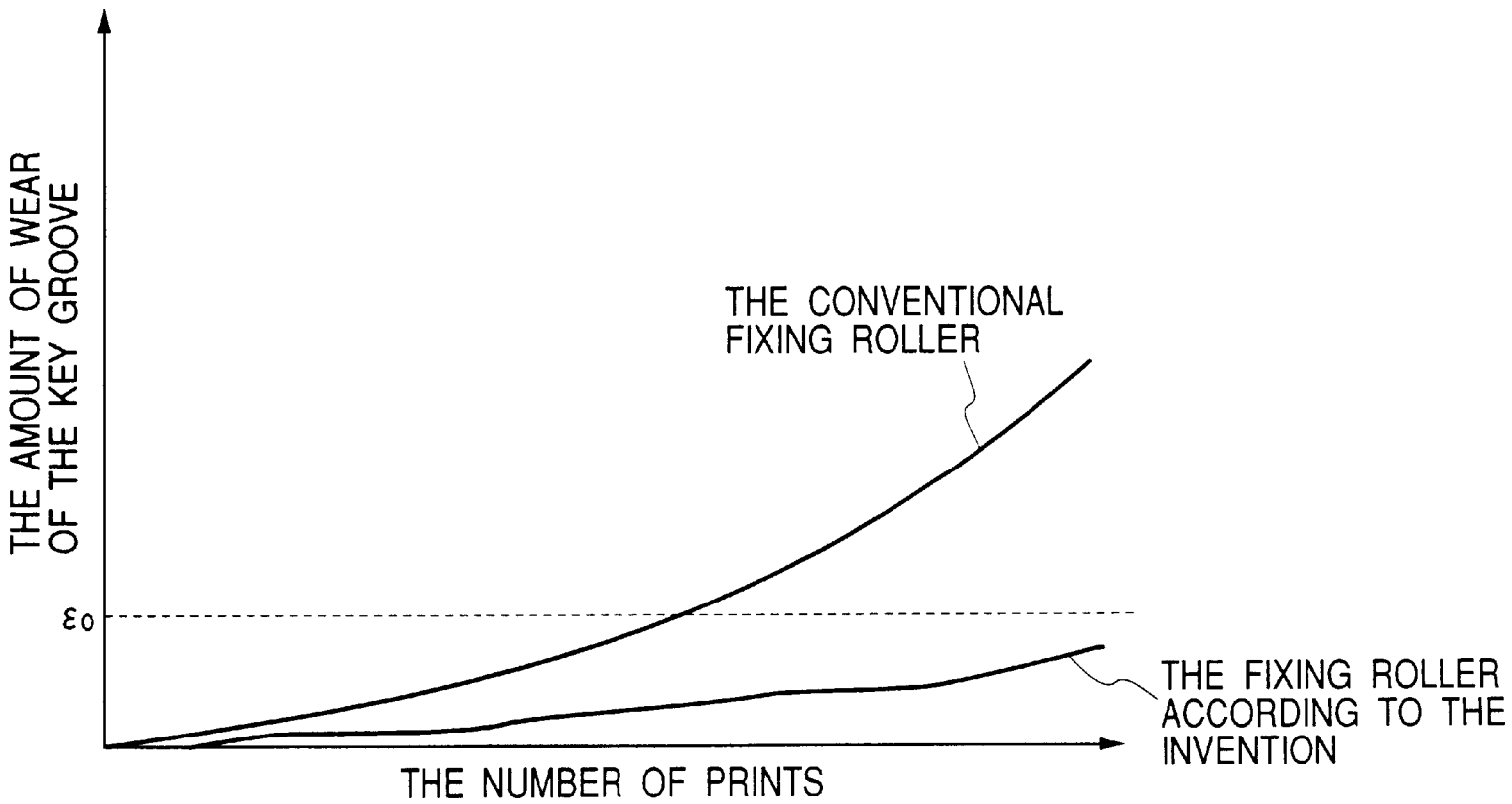
FIG. 3 is an explanatory view showing a relation between amount of wear of a key groove and the number of prints.

FIG. 3 shows relations between amount of wear of the key groove and the number of prints in the heat roller according to the invention and the conventional heat roller. As clear from FIG. 3, it is confirmed that the time when the amount of wear of the key groove reaches a tolerable limit amount $\epsilon_0$, can be made longer by about twice to three times than a case in which the fixing is performed using the conventional heat roller.

In the above embodiment, the case in which the average thickness of the core metal material 14*a* is set to 5 mm is described. Next, other examples will be given as follows.

Using an aluminum core metal material 14*a* having the average thickness of 4 mm and the heat roller 14 having the total length 600 mm, the moment of inertia in the direction of the rotational shaft of the heat roller 14 is made about 47 $kg \cdot cm^2$.

Moreover, using the aluminum core metal material 14*a* having the average thickness of 7 mm and the heat roller 14 having the total length of 600 mm, the moment of inertia in the direction of the rotational shaft of the heat roller 14 is made about 70 $kg \cdot cm^2$.

Accordingly, if the average thickness of the core metal material 14*a* is 7 mm and less (preferably 6 mm and less), the moment of inertia in the direction of the rotational shaft of the heat roller 14 can be reduced. Further, it is confirmed that if the average thickness of the core metal material 14*a* is 5.5 mm and less, the heat capacity of the heat roller 14 can be also reduced.

In case that the shield plates 14*b* are fitted into the inner peripheral portions of both the ends of the core metal material like the heat roller in the above embodiment, the grooves 14*e* for fitting must be provided on the inner peripheral surface of the core metal material. Therefore, a relation between the average thickness and the depth of the groove must be also taken into consideration. Accordingly, in case that the heat roller is equipped with the shield plates like the above embodiment, the lowest limit of the average thickness of the core metal material is about 4 mm.

In the above embodiment, the heat roller is a drive roller. However, in case that a roller that comes into pressure contact with the heat roller has a drive source, it is needless to say that the present invention can be applied to the roller.

As described above, according to the invention, even in a case that the fixing roller is rotated at a high speed, without causing an increase in the consumed electric power, the fixing device and the fixing roller of the image forming apparatus can be provided. The fixing device and the fixing roller of the image forming apparatus can suppress increase of the moment if inertia in the direction of the rotational shaft of the fixing roller, and the early break of the key groove. Further, the fixing device and the fixing roller of the image forming apparatus can lengthen greatly the lifetime of the fixing roller.

What is claimed is:

1. A fixing device in an image forming apparatus comprising:

a first fixing roller;

a second fixing roller coming into pressure contact with the first fixing roller, the second fixing roller including a cylindrical metal core having an outer diameter of 80 to 120 mm and a length in axial direction of 470 to 600 mm, the second fixing roller defining a groove at one end of the cylindrical metal core; and a driving shaft having a protrusion engaged with the groove of the cylindrical metal core;

wherein an average thickness of the cylindrical metal core is regulated so that the moment of inertia in a direction of a rotational shaft of the second fixing roller is less than 70 Kg $\cdot cm^2$.

2. The fixing device according to claim 1 wherein the average thickness of the cylindrical metal core is no less than 4 mm and no more than 7 mm.

3. The fixing device according to claim 1, further comprising a heat source provided within the cylindrical metal core.

4. The fixing device according to claim 1, further comprising:

a plurality of second grooves defined in a circumferential direction at inner peripheral portions on both ends of the cylindrical metal core; and shield plates attached into the second grooves.

* * * * *